United States Patent [19]

Walker et al.

[11] Patent Number: 5,056,569

[45] Date of Patent: Oct. 15, 1991

[54] HOSE ASSEMBLY AND METHOD OF MAKING THE SAME

[75] Inventors: Glenn K. Walker, Miamisburg, Ohio; Rodger P. Grantham, Springfield; Guy L. Renshaw, Ash Grove, both of Mo.

[73] Assignee: Dayco Products, Inc., Dayton, Ohio

[21] Appl. No.: 152,612

[22] Filed: Feb. 5, 1988

Related U.S. Application Data

[63] Continuation of Ser. No. 913,060, Sep. 29, 1986, abandoned.

[51] Int. Cl.[5] ..... B67D 5/06

[52] U.S. Cl. ..... 141/44; 141/46; 141/59; 141/286; 141/302; 138/133

[58] Field of Search ..... 285/133.1; 138/131–133; 141/44–46, 59, 37, 67, 65, 285, 286, 290, 310, 302; 220/85 VR, 85 VS

[56] References Cited

U.S. PATENT DOCUMENTS

| | | | |
|---|---|---|---|
| 2,236,731 | 4/1941 | Oberly | 138/133 X |
| 2,837,121 | 6/1958 | Roberts | 138/133 X |
| 3,213,889 | 10/1965 | Cotman, Jr. | 285/133.1 X |
| 3,274,316 | 9/1966 | Songer | 138/131 X |
| 3,638,970 | 2/1972 | Sandquist et al. | 285/133.1 X |
| 3,863,687 | 2/1975 | Alquist | 141/45 |
| 3,913,633 | 10/1975 | Hiller | 141/45 |
| 3,981,335 | 9/1976 | Deters | 141/46 |
| 4,072,934 | 2/1978 | Hiller et al. | 141/59 X |
| 4,090,539 | 5/1978 | Krupp | 141/198 |
| 4,095,626 | 6/1978 | Healy | 141/46 |
| 4,149,739 | 4/1979 | Morris | 285/133.1 |
| 4,167,957 | 9/1979 | Voelz et al. | 141/95 |
| 4,167,958 | 9/1979 | Voelz | 141/95 |
| 4,306,594 | 12/1981 | Planck | 141/59 |
| 4,566,504 | 1/1986 | Furrow et al. | 141/59 |
| 4,687,033 | 8/1987 | Furrow et al. | 141/59 |
| 4,749,009 | 6/1988 | Faeth | 141/45 |
| 5,005,613 | 4/1991 | Stanley | 141/45 |

FOREIGN PATENT DOCUMENTS

| | | | |
|---|---|---|---|
| 0155186 | 9/1985 | European Pat. Off. | 141/45 |

*Primary Examiner*—Ernest G. Cusick

*Attorney, Agent, or Firm*—Joseph V. Tassone

[57] ABSTRACT

A hose assembly and method of making the same are provided, the hose assembly having a first fluid passage therein for respectively conveying a volatile liquid in one direction to a container and a second fluid passage therein for returning the vapors of the volatile liquid from the container, the assembly comprising a flexible inner hose having an outer peripheral surface and defining the first fluid passage therein, and a flexible outer hose having an inner peripheral surface and being disposed around the inner hose, the inner peripheral surface of the outer hose and the outer peripheral surface of the inner hose defining the second fluid passage therebetween, the inner hose having a Venturi therein that tends to remove liquid from a certain area of the second fluid passage, the outer hose having wire reinforcing therein to tend to prevent inward crushing of the outer hose in a manner to damage the Venturi.

4 Claims, 3 Drawing Sheets

HOSE ASSEMBLY AND METHOD OF MAKING THE SAME

CROSS REFERENCE TO RELATED APPLICATION

This application is a continuation Pat. application of its copending parent Pat. application, Ser. No. 913,060, filed Sept. 29, 1986, now abandoned.

BACKGROUND OF THE INVENTION

1. Field of the Invention

This invention relates to a new hose assembly and to a new method of making such a hose assembly.

2. Prior Art Statement

It is known to provide a hose assembly having a first fluid passage therein for respectively conveying a volatile liquid in one direction to a container and a second fluid passage therein for returning the vapors of the volatile liquid from the container, the assembly comprising a flexible inner hose having an outer peripheral surface and defining the first fluid passage therein, and a flexible outer hose having an inner peripheral surface and being disposed around the inner hose, the inner peripheral surface of the outer hose and the outer peripheral surface of the inner hose defining the second fluid passage there between, the inner hose having a Venturi means therein that tends to remove liquid from a certain area of the second fluid passage, the Venturi means having an inlet opening that is generally flat and generally faces the inner peripheral surface so as to be adapted to interconnect the second fluid passage with the first fluid passage through the Venturi means. For example see the U.S. Pat. to Faeth, No. 4,749,009, and see FIG. 6 of this application except that in the prior known hose assembly, the outer hose 29 has a smooth and noncorreugated inner peripheral surface means 30 as illustrated in FIGS. 2 and 3 of the aforementioned U.S. Pat. to Faeth, No. 4,749,000.

It is also known to provide wire reinforcing means in a hose construction to tend to prevent inward crushing of that hose construction.

It is also known to provide an outer hose of a hose assembly that is corrugated in a helical manner so that the inner peripheral surface means thereof defines alternating crests and valleys with each crest and valley defining an arcuate surface.

It is also known to provide a hose assembly having fluid passages therein for respectively conveying a volatile liquid in one direction to a container and returning vapors of the volatile liquid from the container, the assembly comprising a flexible inner hose having an outer peripheral surface and defining an inner one of the passages, a flexible outer hose having an inner peripheral surface and being disposed around the inner hose, the inner peripheral surface of the outer hose and the outer peripheral surface of the inner hose defining an outer one of the passages, a coupling fixed to an end portion of the outer hose, a tubular fitting fixed to an end portion of the inner hose, and clip means holding the fitting and the end portion of the inner hose substantially concentrically within the coupling and the outer hose to define a continuation of the outer passage. For example, see the U.S. Pat. to Basham, No. 3,980,112.

SUMMARY OF THE INVENTION

It is one feature of this invention to provide a new hose assembly having means to protect the Venturi means of the inner hose thereof.

In particular, it was found according to the teachings of this invention that the outer hose of the hose assembly can be made to be relatively flexible and still protect the Venturi means of the inner hose of the assembly if the outer hose has a wire reinforcing means therein.

For example, one embodiment of this invention provides a hose assembly having a first fluid passage therein for conveying a volatile liquid in one direction to a container and a second fluid passage therein for returning the vapors of the volatile liquid from the container, the assembly comprising a flexible inner hose having an outer peripheral surface and defining the first fluid passage therein, and a flexible outer hose having an inner peripheral surface and being disposed around the inner hose, the inner peripheral surface of the outer hose and the outer peripheral surface of the inner hose defining the second fluid passage therebetween, the inner hose having a Venturi means therein that tends to remove liquid from a certain area of the second fluid passage, the outer hose having wire reinforcing means therein to tend to prevent inward crushing of the outer hose in a manner to damage the Venturi means.

It is another feature of this invention to provide new means in the hose assembly to tend to remove, as much as possible, the liquid that accumulates in a low portion of the outer passage of the hose assembly.

In particular, it was found according to the teachings of this invention that the inlet means of the Venturi means of the inner hose means thereof will not be completely blocked if the outer hose is corrugated in a helical manner so that the inner peripheral surface thereof defines alternating crests and valleys with each crest and each valley defining an arcuate surface.

For example, another embodiment of this invention provides a hose assembly having a first fluid passage therein for conveying a volatile liquid in one direction to a container and a second passage therein for returning the vapors of the volatile liquid from the container, the assembly comprising a flexible inner hose having an outer peripheral surface and defining the first fluid passage therein, and a flexible outer hose having an inner peripheral surface and being disposed around the inner hose, the inner peripheral surface of the outer hose and the outer peripheral surface of the inner hose defining the second fluid passage therebetween, the inner hose having a Venturi means therein that tends to remove liquid from a certain area of the second fluid passage, the outer hose being corrugated in a helical manner so that the inner peripheral surface thereof defines alternating crests and valleys with each crest and each valley defining an arcuate surface, the Venturi means having an inlet means that is generally flat and is of a size so that the arcuate valleys and crests will not completely block the same when the inlet means is engaging the inner surface of the outer hose.

It is another feature of this invention to provide a new hose assembly having a unique clip means for holding parts of the hose assembly substantially in concentric relation.

In particular, it was found according to the teachings of this invention that the clip means can comprise a spider-like member having a ring portion telescopically disposed on a fitting of the hose assembly and a plurality of arms radiating outwardly from the ring portion and being engageable with a coupling of the assembly.

For example, another embodiment of this invention provides a hose assembly having fluid passages therein for respectively conveying a volatile liquid in one direction to a container and returning vapors of the volatile liquid from the container, the assembly comprising a flexible inner hose having an outer peripheral surface and defining an inner one of the passages, a flexible outer hose having an inner peripheral surface and being disposed around the inner hose, the inner peripheral surface of the outer hose and the outer peripheral surface of the inner hose defining an outer one of the passages, a coupling fixed to an end portion of the outer hose, a tubular fitting fixed to an end portion of the inner hose, and clip means holding the fitting and the end portion of the inner hose substantially concentrically within the coupling and the outer hose to define a continuation of the outer passage, the clip means comprising a spider-like member having a ring portion telescopically disposed on the fitting and a plurality of arms radiating outwardly from the ring portion and being engageable with the coupling.

Accordingly, it is an object of this invention to provide a new hose assembly having fluid passages therein for respectively conveying a volatile liquid in one direction to a container and returning vapors of the volatile liquid from the container, the hose assembly of this invention having one or more of the novel features of this invention as set forth above or hereinafter shown or described.

Another object of this invention is to provide a new method of making such a hose assembly, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 1 is a side view of the hose assembly of this invention being utilized for dispensing gasoline from a conventional curbside gasoline pump or the like to a nozzle means for insertion in the gasoline tank of a transportation vehicle or the like.

DESCRIPTION OF THE PREFERRED EMBODIMENTS

Figure 1:
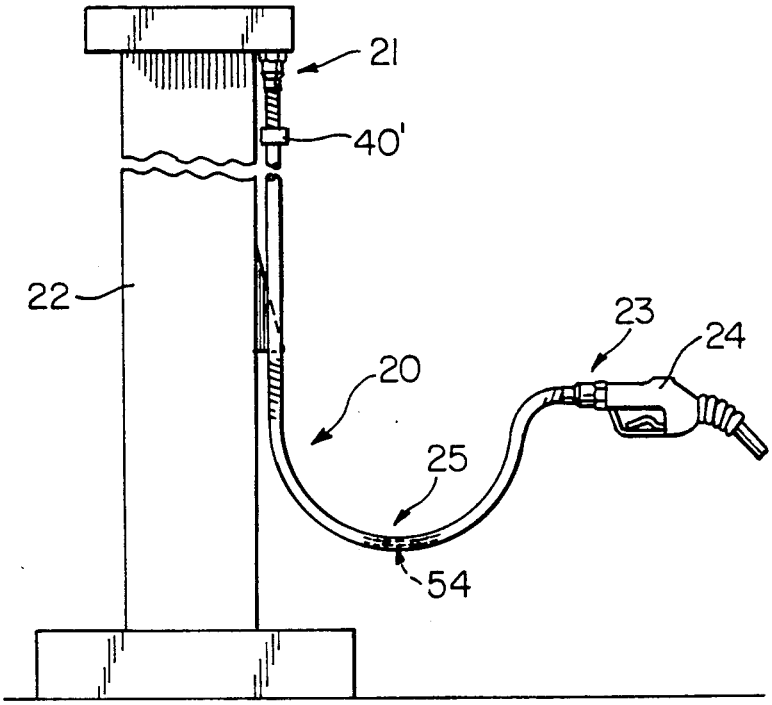

While the various features of this invention are hereinafter illustrated and described as being particularly adapted to provide a hose assembly for conveying volatile fluids, it is to be understood that the various features of this invention can be utilized singly or in various combinations thereof to provide a hose assembly for other purposes as desired.

Therefore, this invention is not to be limited to only the embodiments illustrated in the drawings, because the drawings are merely utilized to illustrate one of the wide variety of uses of this invention.

Figure 2:
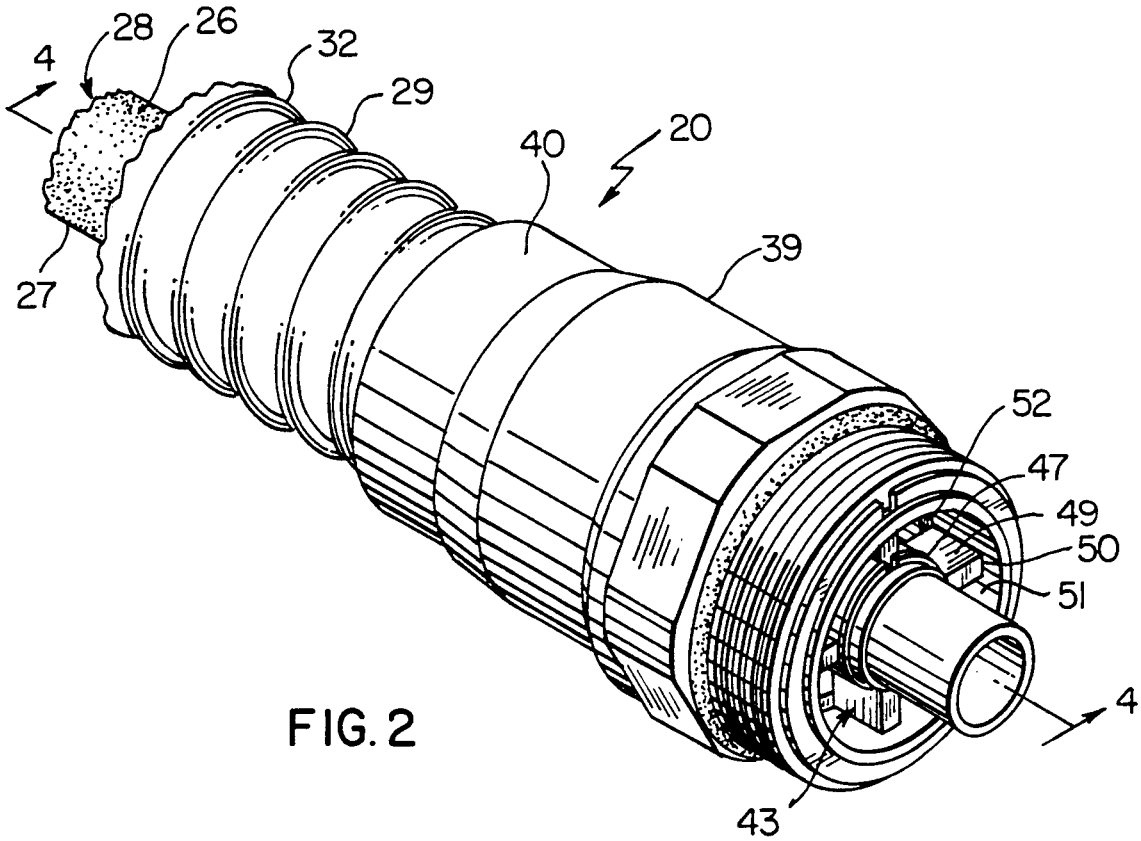
FIG. 2 is an enlarged fragmentary perspective view of one end of the hose assembly of this invention.

Referring now to FIGS. 1 and 2, the new hose assembly of this invention is generally indicated by the reference numeral 20 and is shown in FIG. 1 as having one end 21 thereof interconnected to a conventional gasoline pump 22 or the like and the other end 23 thereof interconnected to a conventional dispensing nozzle 24 which is shown in a normal position for dispensing fuel into the gas tank or storage container of a transportation vehicle or the like whereby an intermediate portion 25 of the hose assembly 20 provides a low portion thereof from which any collected liquid therein is to be removed by the hose assembly 20 of this invention in a manner hereinafter set forth and for the reasons set forth in the U.S. Pat. to Furrow et al, No. 4,566,504 whereby this patent is being incorporated into this disclosure by this reference thereto.

The hose assembly 20 comprises a flexible inner hose 26 having an outer peripheral surface 27 and defining an inner passage 28 therein through which the liquid from the pump means 22 is adapted to be conveyed in a direction toward the nozzle 24 in a conventional manner. The hose assembly 20 also comprises a flexible outer hose 29 that has an inner peripheral surface 30, FIG. 6, that cooperates with the outer peripheral surface 27 of the inner hose 26 to define an outer passage 31 therebetween and through which vapors of the dispensed volatile liquid can be returned from the nozzle means 24 back to the pump means 22 in a manner conventional in the art, such as set forth in the aforementioned U.S. Pat. to Furrow et al, No. 4,566,504 as well as in the aforementioned U.S. Pat. to Basham, No. 3,980,112 whereby this patent is also being incorporated into this disclosure by this reference thereto.

Figure 6:
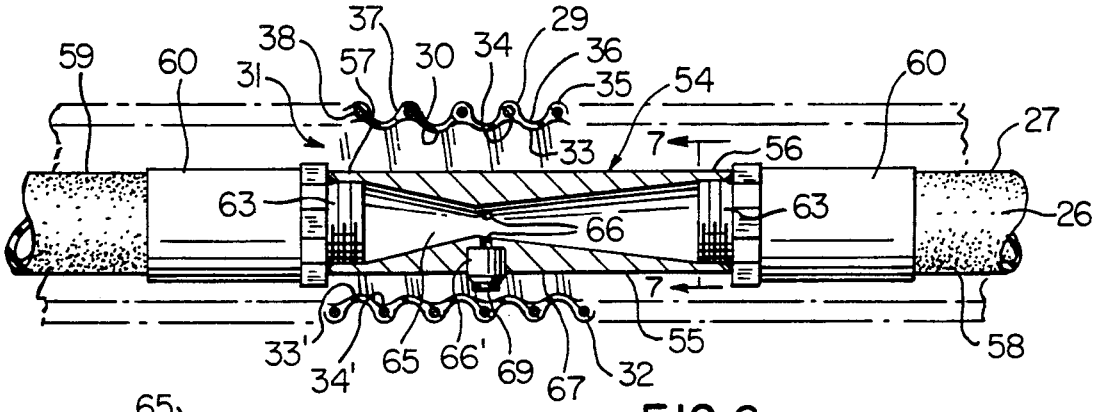
FIG. 6 is an enlarged fragmentary view that is partially in cross section and is taken on line 6—6 of FIG. 1.
Figure 7:
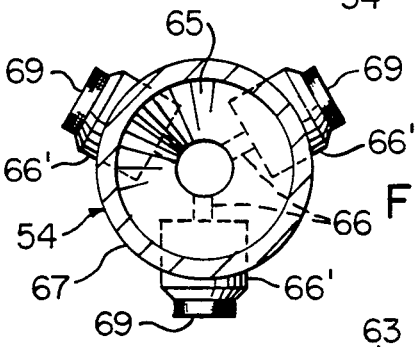
FIG. 7 is a cross-sectional view taken on line 7—7 of FIG. 6.

While the inner hose 26 has substantially smooth inner and outer peripheral surfaces, the main body portion 32 of the outer hose 29 of this invention is corrugated in a helical manner to define alternating crests 33 and valleys 34 on the inner peripheral surface 30 thereof as well as corresponding and alternating crests 35 and valleys 36 on the outer peripheral surface 37 thereof as illustrated in FIG. 6, each crest 33 and each valley 34 defining an arcuate surface 33' or 34' for a purpose hereinafter described.

In addition, the outer hose 29 has a reinforcing wire-like member 38 embedded therein and also being disposed in a helical manner along the length of the body portion 32 of the hose 29, the wire reinforcing member 38 being formed of any suitable material, such as metallic material and thereby rendering the outer hose 29 substantially resistant to inward crushing thereof about the inner hose 26 for a purpose hereinafter set forth. However, because the body portion 32 of the outer hose 29 is corrugated in the manner previously set forth, the outer hose 29 is relatively flexible.

While the body portion 32 of the outer hose 29 can be formed of any suitable material, one working embodiment thereof comprises a precurved wire helix with an external urethane coating extruded thereon. Thereafter, an outer cover of urethane is extruded over the coated wire whereby the thus coated wire helps the preforming of the wire and enhances the adhesion of the outer urethane material to the reinforcing wire while the resulting structure has the wire 38 effectively embedded thereon. Of course, the body portion 32 of the outer hose 29 could be formed of different materials and by a different method, if desired.

In order to attach outer couplings 39 to the opposed ends of the body portion 32 of the outer hose 29, substantially smooth and non-reinforced cylindrical cuffs 40 of urethane are respectively bonded or molded to the opposed ends of the outer hose 29 so that the cuffs 40 can be secured to the couplings 39 in any suitable manner, such as in the manner set forth in the aforementioned U.S. Pat. to Basham, No. 3,980,112.

Figure 4:
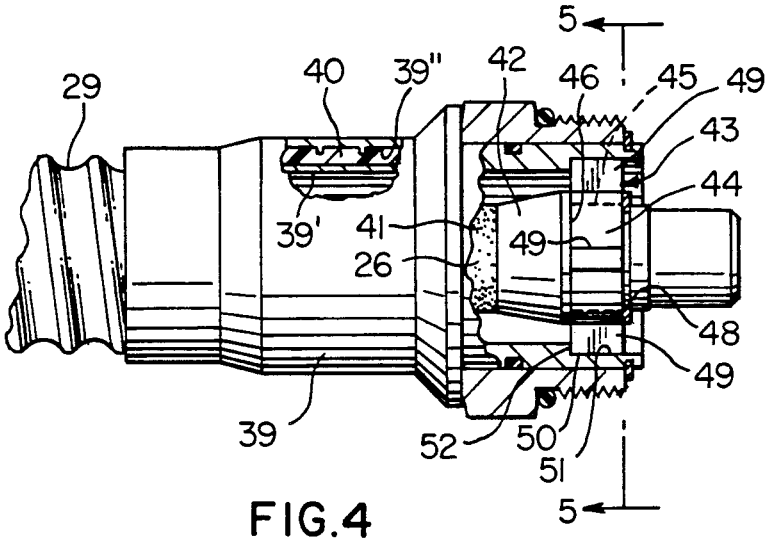
FIG. 4 is a fragmentary cross-sectional view taken on line 4—4 of FIG. 2.

However, as illustrated in FIG. 4, it can be seen that the cuff 40 of the outer hose 29 is inserted in the coupling 39 and an internal metallic sleeve 39' is radially outwardly expanded to compress the cuff 40 against the internal peripheral surface 39'' of the coupling 39 and also to hold the cuff 40 in deformed relation into annular grooves of the coupling 39.

It is also to be understood that the outer hose 29 could be formed from other than the aforementioned plastic materials and thereby can comprise any suitable polymeric material that is resistant to gasoline, oil, etc.

For example, another working embodiment of the outer hose 29 of this invention was not corrugated but had a helically disposed wire reinforcing member embedded therein with the same being formed from an inner tube of nitrile rubber having a rayon braid laid on the same and then a jacket of nitrile rubber disposed on top of the rayon braid. The wire reinforcing helix was disposed on the jacket and then another rayon braid was disposed over the same. An outer cover was disposed on top of the outer rayon braid and comprised a compound of nitrile rubber and PVC with the resulting outer hose being relatively smooth on the inner and outer peripheral surfaces thereof. The ends of such outer hose were joined to couplings similar to couplings 39.

The inner hose 26 of the hose assembly 20 of this invention can also be formed of any suitable polymeric material and in one working embodiment thereof comprises a tube of nitrile rubber that is wire reinforced and has a cover of a compound comprising nitrile rubber and PVC.

Figure 3:
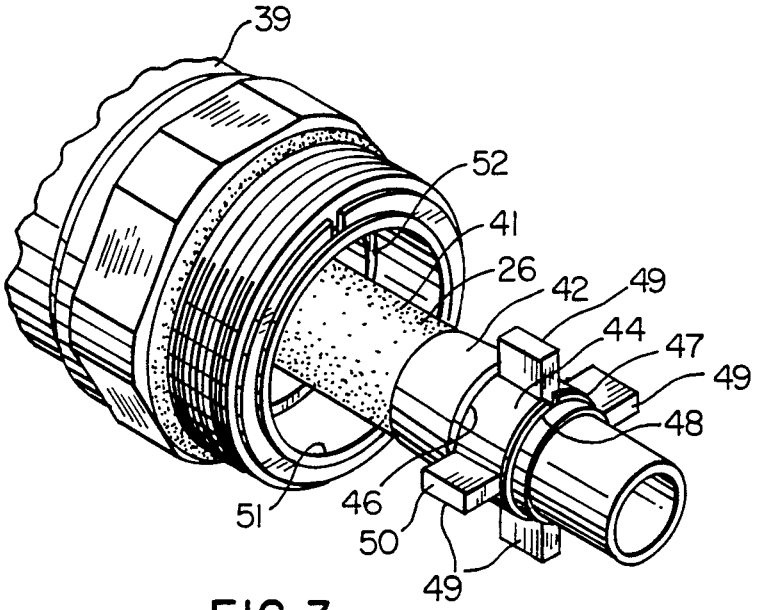
FIG. 3 is a view similar to FIG. 2 and illustrates the inner hose of the hose assembly pulled outwardly relative to the outer hose thereof.

As illustrated in FIGS. 3 and 4, each opposed end portion 41 of the inner hose 26 is attached to a metallic fitting 42 substantially in the same manner set forth above in regard to the coupling 39 or as in the aforementioned patent to Basham, No. 3,980,112 and the interconnected fitting 42 is held in substantially concentric relation within its cooperating coupling 39 by a clip means of this invention that is generally indicated by the reference numeral 43.

The clip means 43 is formed from any suitable material, such as extruded aluminum, and has a ring-like portion 44 adapted to be telescopically disposed on a cylindrical portion 45 of the fitting 42 and be held against a shoulder 46 thereof by a C-ring 47 received in an annular groove 48 in the fitting 42. The clip means 43 includes a plurality of integral arms or legs 49 extending radially outwardly from the ring portion 44 and in spaced apart relation so that the end surfaces 50 of the arms 49 are adapted to engage against an internal peripheral surface 51 of the coupling 39 to maintain the concentric relationship illustrated in FIG. 4.

In addition, the arms 49 of the clip means 43 are adapted to abut against an internal shoulder 52 of the coupling 39 to positively connect the inner and outer hoses 26 and 29 together.

In particular, with the inner hose 29 having one end thereof fixed to the pump 22 by its coupling 39 and fitting 42, a person pulling on the outer hose 29 toward the nozzle 24 causes the coupling 39 adjacent the nozzle 24 to have its shoulder 52 engage against the arms 49 of the clip means 43 and thereby not be movable relative to the inner hose 26 as the clip means 43 is fastened to the inner hose 26 at the fitting 42 thereof as previously set forth.

Therefore, by utilizing the interlocking feature of the clip means 43 as previously described, the outer hose 29 can be formed of the aforementioned lightweight plastic material.

Figure 5:
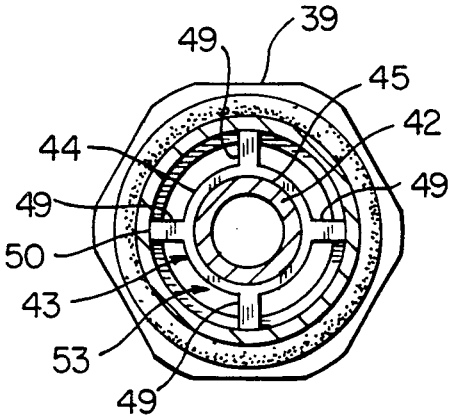
FIG. 5 is a cross-sectional view taken on line 5—5 of FIG. 4.

Also, it can be seen that the spacing 53 between the arms 49 of the clip means 43 as illustrated in FIG. 5 provide a continuation of the outer passage 31 of the hose assembly 20 for conveying vapors therethrough for the purpose fully set forth in the aforementioned patent to Basham, No. 3,980,112.

As fully described in the aforementioned U.S. Pat. to Furrow et al, No. 4,566,504, liquid in the outer passage 31 of the hose assembly 20 tends to collect at the low point or area 25 as illustrated in FIG. 1 and it is known from others to include a Venturi means in the inner hose 26 so that the same can have its inlet means disposed in the passage means 31 at the area 25 for sucking the liquid from that area 25 back into the inner passage 28 and, thus, to the nozzle 24 as the liquid flows through the inner passage 28 from the pump 22 and passes through the Venturi means to the nozzle 24.

Such Venturi means is generally indicated by the reference numeral 54 in FIG. 6 and comprises a tubular metallic member 55 having opposed ends 56 and 57 respectively coupled to adjacent end portions 58 and 59 of the inner hose 26 by coupling members 60 of this invention.

Figure 8:
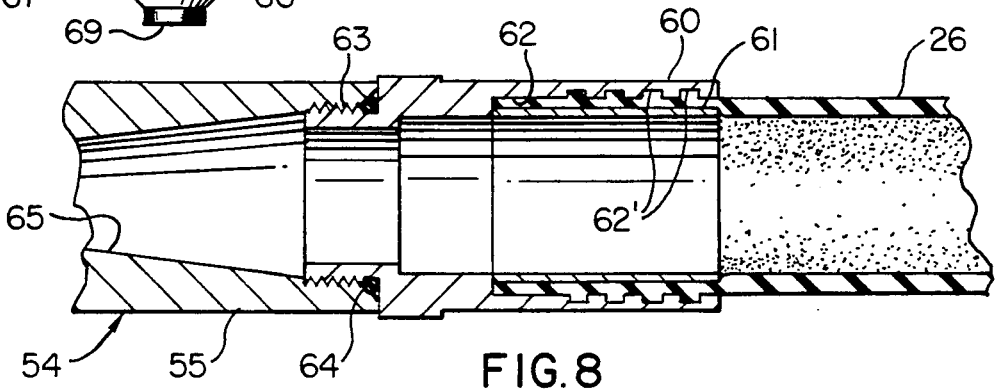
FIG. 8 is an enlarged fragmentary view that is partially in cross section of a part of the assembly of FIG. 6.

In particular, it can readily be seen in FIG. 8 that each coupling member 60 is interconnected to its respective end portion 58 or 59 of the inner hose 26 by an internally disposed metallic sleeve 61 being internally expanded in the end portion 58 or 59 to trap the end portion 58 or 59 against the internal peripheral surface 62 of the coupling 60 as well as into the annular grooves 62' thereof as illustrated.

Each coupling 60, in turn, has an externally threaded projection 63 which is adapted to be threaded into the internally threaded end 56 or 57 of the Venturi tube 55 and be sealed against the same by an 0-ring seal means 64 and/or by a suitable sealant disposed between the interconnected threads. In this manner the adjacent ends 58 and 59 of the inner hose 26 are respectively interconnected to a Venturi passage means 65 that passes through the tubular member 55 and functions in a manner conventional in the Venturi art for drawing fluid through an inlet 66 thereof that leads from the external peripheral surface 67 of the tubular member 55 to the Venturi passage 65 thereof.

For example, the inlet 66 can comprise three such equally spaced apart passages 66 radiating about the tubular member 55 and each having a porous filtering member 66' therein containing a one-way check valve means therein (not shown) and extending outwardly from the external peripheral surface 67 of the tubular member 55 to define a substantially flat inlet means 69 that is in communication with the outer passage 31 of the hose assembly 20.

While the Venturi tube 55 and couplings 60 can be formed of any suitable material, one working embodiment thereof has the Venturi tube formed of brass and the couplings 60 formed of aluminum.

Figure 9:
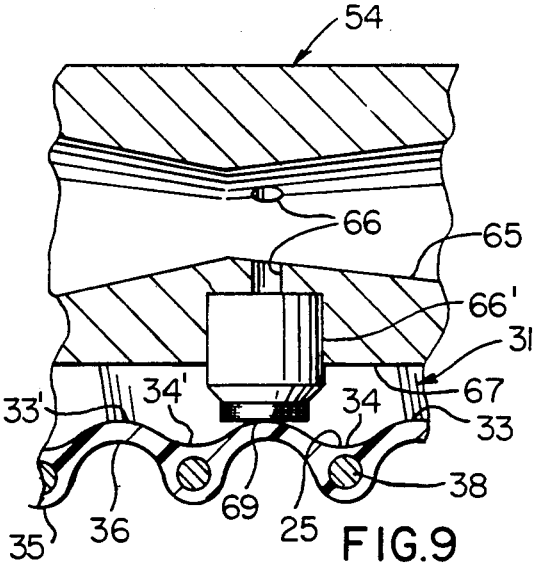
FIG. 9 is an enlarged fragmentary view of a part of FIG. 6 and illustrates one position of the inlet means of the Venturi means relative to the inner surface of the outer hose.
Figure 10:
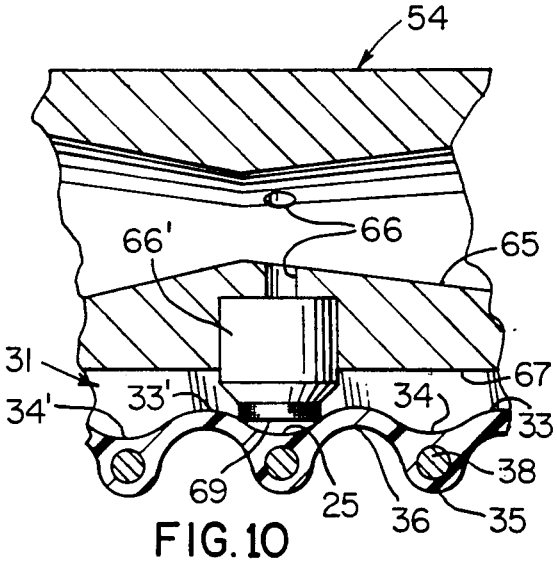
FIG. 10 is a view similar to FIG. 9 and illustrates another possible position of the inlet means of the Venturi means of the inner hose relative to the inner surface of the outer hose.

It is believed that by forming the internal peripheral surface 30 of the outer hose 29 with the alternating crests 33 and valleys 34 each having an arcuate surface 33' or 34', the bottom inlet means 69 of the Venturi means 54 can be disposed adjacent the same as illustrated respectively in FIGS. 9 and 10 and it can be seen that the substantially flat inlet means 69 is not completely blocked by such crests 33 or valleys 34 so that the majority of the liquid that collects in the low point 25 of the passage 31 of the hose assembly 20 will be readily removed therefrom by the Venturi means 54 than would be the case when the lowest inlet means thereof is completely blocked by engaging against a non-corrugated internal peripheral surface of the outer hose.

Thus, it can be seen that in the operation of the hose assembly 20 of this invention, the inner passage 28 thereof is adapted to permit a flow of fuel from the pump 20 out through the nozzle 24 in a conventional manner and as a flow of fuel passes through the inner passage 28, the flow of fuel causes the Venturi means 54 to act as a pump and thereby draw by suction any liquid that collects in the outer passage 31 in the low area 25 thereof into that flowing stream of fuel through the inner passage 28 to tend to remove the same from blocking the outer passage 31 which is utilized for returning vapors from the nozzle 24 back to the pump means 22 in the manner fully set forth in the aforementioned U.S. Pats. to Furrow et al, No. 4,566,504, and to Basham, No. 3,980,112.

From the above, it can be seen that the hose assembly 20 of this invention is relatively lightweight and flexible while still being adapted to withstand the constant abuse that is normally provided at filling stations and the like, such as the constant flexing, abrasion, pulling etc., that is associated with any curb pump hose arrangement. In addition, the outer hose 29 of the hose assembly 20 of this invention provides sufficient support through the wire reinforcing means 38 thereof to protect the Venturi means 54 of the inner hose 26 that is utilized in the vapor recovery operation as previously described.

The inner hose 26 of the hose assembly 20 of this invention is adapted to handle end forces that result from excess pulling on the hose assembly 20 because the inner hose 26 utilizes a wire braid reinforcing construction.

The outer hose 29 is lightweight and flexible while still being rigid enough to protect the Venturi means 54 because the same is corrugated for flexibility, has the wire reinforcement means 38 for protection and is formed of urethane to provide the light weight thereof.

The spider-like clip means 43 of this invention which hold the couplings 39 and fittings 42 at each end of the hose assembly 20 in concentric relation also transfer any end pull forces on the outer hose 29 to the inner hose 26 and thereby permits the use of a lightweight and flexible outer hose 29.

Also, it can be seen that the attaching of the outer hose 29 to the non-reinforced cuffs 40 each of which have smooth inner and outer peripheral surfaces allows for internal expansion of a sleeve 39' in each coupling 39 to improve the vapor flow therethrough, each expanded length 39' also acting as a strain reliever that minimizes bends on both the inner and outer hoses 26 and 29. Also, a clip (not shown) can be attached to the wire reinforcement 38 through the cuff 40 and be attached to the outer coupling 39 so as to act as a static ground.

In addition, it can be seen that other polymeric structure can be molded or bonded to the outer hose 29 of the hose assembly in the same manner as the cuffs 40. For example, a suitable member 40', FIG. 1, can be molded or bonded to an intermediate part of the outer hose 29 and provide a means for attaching a conventional spring loaded reel-in line (not shown) from the pump means 22 to the hose assembly 20. Of course, such member 40' could be formed of other material and can merely be fastened to the outer hose 29 by fastening means other than by molding or bonding, as desired.

In regard to the inner hose 26, the couplings 60 are attached to the inner hose 26 by the internally expanded sleeves 61 to allow for maximum flow through the inner hose 26 and the O-ring seal and/or thread sealant design of the couplings 60 permits the couplings 60 to mate with the threads of the Venturi tube 55 so that the O-rings 64 and/or thread sealant provide excellent seals between the coupling members 60 and the Venturi tube 55. Also, the screw threads 63 on the Venturi tube 55 and coupling members 60 provide good pull strength for the entire assembly 20.

Thus, it can be seen that this invention provides a new method of making such a hose assembly.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a hose assembly having a first fluid passage therein for conveying a volatile liquid in one direction to a container and a second fluid passage therein for returning the vapors of the volatile liquid from the container, the assembly comprising a flexible inner hose having an outer peripheral surface and defining said first fluid passage therein, and a flexible outer hose having an inner peripheral surface and being disposed around said inner hose, said inner peripheral surface of said outer hose and said outer peripheral surface of said inner hose defining said second fluid passage therebetween, said inner hose having a Venturi means therein that tends to remove liquid from a certain area of said second fluid passage, said Venturi means having an inlet opening that is generally flat and generally faces said inner peripheral surface so as to be adapted to interconnect said second fluid passage with said first fluid passage through said Venturi means, the improvement wherein said outer hose is corrugated in a helical manner so that said inner peripheral surface thereof defines alternating crests and valleys with each crest and each valley defining an arcuate surface, said arcuate valleys and crests being of such a size that the same will not completely block said inlet opening when said inlet opening is engaging said inner surface of said outer hose and is facing substantially vertically downwardly.

2. A hose assembly as set forth in claim 1 wherein said Venturi means has a plurality of said inlet openings that radiate outwardly in spaced apart relation about said Venturi means.

3. A hose assembly as set forth in claim 1 wherein said outer hose has wire reinforcing means therein to tend to prevent inward crushing of said outer hose in a manner to damage said Venturi means.

4. A hose assembly as set forth in claim 3 wherein said wire reinforcing means comprises a single wire of metallic material disposed in a helical manner along the axial length of said outer hose.

* * * * *